US008677691B2

(12) United States Patent
Royer et al.

(10) Patent No.: US 8,677,691 B2
(45) Date of Patent: Mar. 25, 2014

(54) SEALING DEVICE AND CORRESPONDING ASSEMBLY

(75) Inventors: Jean-Claude Royer, Lesmenils (FR); Vincent Rotharmel, Vandieres (FR)

(73) Assignee: Saint-Gobain Pam, Nancy (FR)

( * ) Notice: Subject to any disclaimer, the term of this patent is extended or adjusted under 35 U.S.C. 154(b) by 0 days.

(21) Appl. No.: 13/518,821

(22) PCT Filed: Dec. 21, 2010

(86) PCT No.: PCT/FR2010/052847

§ 371 (c)(1), (2), (4) Date: Aug. 10, 2012

(87) PCT Pub. No.: WO2011/077033

PCT Pub. Date: Jun. 30, 2011

(65) Prior Publication Data

US 2012/0317885 A1 Dec. 20, 2012

(30) Foreign Application Priority Data

Dec. 24, 2009 (FR) ..... 09 59595

(51) Int. Cl.
*E05F 1/10* (2006.01)

(52) U.S. Cl.
USPC ..... 49/386

(58) Field of Classification Search
USPC ..... 49/386, 387, 339, 344, 346
See application file for complete search history.

(56) References Cited

U.S. PATENT DOCUMENTS

| | | | | | |
|---|---|---|---|---|---|
| 933,070 | A * | 9/1909 | Gleason | 114/201 R |
| 2,259,970 | A * | 10/1941 | Benzick | 16/286 |
| 2,612,651 | A * | 10/1952 | Roethel | 16/295 |
| 2,939,738 | A * | 6/1960 | Lyons | 292/272 |
| 4,315,495 | A * | 2/1982 | Jellies | 126/194 |
| 5,205,073 | A * | 4/1993 | Lyons, Sr. | 49/386 |
| 5,301,469 | A * | 4/1994 | Lyons, Sr. | 49/386 |
| 5,373,665 | A * | 12/1994 | Lyons, Sr. | 49/386 |
| 5,673,810 | A * | 10/1997 | Rothrock | 220/264 |
| 6,021,606 | A * | 2/2000 | Kos | 49/386 |
| 6,715,715 | B1 * | 4/2004 | Petersen | 244/114 R |
| 7,216,459 | B1 * | 5/2007 | Akkala et al. | 52/20 |
| 7,638,962 | B2 * | 12/2009 | Cardwell | 318/484 |
| 8,166,706 | B2 * | 5/2012 | Slimak et al. | 49/386 |
| 2006/0005468 | A1 * | 1/2006 | McCullough | 49/387 |
| 2006/0236610 | A1 * | 10/2006 | Barnum | 49/339 |
| 2009/0260293 | A1 | 10/2009 | Lough | |

FOREIGN PATENT DOCUMENTS

| | | | |
|---|---|---|---|
| DE | 100 18 732 | A1 | 7/2002 |
| EP | 0 074 880 | A1 | 3/1983 |
| EP | 0 384 484 | A1 | 8/1990 |
| EP | 0 495 731 | A1 | 7/1992 |
| FR | 2 678 307 | A1 | 12/1992 |
| WO | WO 03/100179 | A1 | 12/2003 |

OTHER PUBLICATIONS

An International Search Report, mailed Aug. 26, 2011, which issued during the prosecution of PCT/FR2010/052847 which corresponds to the present application.

* cited by examiner

*Primary Examiner* — Jerry Redman
(74) *Attorney, Agent, or Firm* — McDermott Will & Emery LLP

(57) ABSTRACT

The present invention relates to a sealing device, of the type including a base body suitable for sealing an opening, movable between an open position and a closed position, a thrust element having first and second ends, and a slack configuration and a tight configuration, and the first end of the thrust element being connected to the base body.

16 Claims, 12 Drawing Sheets

SEALING DEVICE AND CORRESPONDING ASSEMBLY

CROSS REFERENCE TO RELATED APPLICATIONS

This application is a U.S. National Phase application under 35 U.S.C. §371 of International Application No. PCT/FR2010/052847, filed on Dec. 21, 2010 which claims priority to FR 09 59595, filed on Dec. 24, 2009. All of these applications are herein incorporated by reference.

BRIEF SUMMARY OF THE INVENTION

The present invention relates to a sealing device, of the type including:

- a base body suitable for sealing an opening, movable between an open position and a closed position,
- a thrust element having first and second ends, and a slack configuration and a tight configuration,
- the first end of the thrust element being connected to the base body.

It more particularly applies to the field of devices for covering chambers for accessing underground networks, such as access hatches for telecommunications networks, manhole covers for visiting or inspecting water grids, sewer grates, and valve chambers. Typically, these covering devices include a frame and a cover adapted to be tilted between open and closed positions. In order to facilitate the movement of the cover between the open and closed positions thereof, the known devices are equipped with a power cylinder. The cylinder is secured on the one hand to the cover and on the other hand to the frame. The cylinder, compressed between the frame and the cover, pushes on the frame so as to assist with opening of the cover.

The cylinder is typically fastened to the frame and the cover by using pins or bolts that are difficult to assemble. Furthermore, the manufacture of such devices is difficult and costly due to the use of a large number of mechanical elements that must often be welded or molded.

Furthermore, the assembly of all of these elements is difficult, and the disassembly of the cylinder for placement of the cover may prove dangerous, as the cylinder is generally compressed.

The invention aims to propose a sealing device that makes the manufacture, placement and removal of the cover easier and more cost-effective.

To that end, the invention relates to a sealing device of the type indicated above, the sealing device also including a connecting element connected to the base body and connected to the second end of the thrust element, as well as a bearing member adapted to bear on a wall surrounding the opening when the base body is moved between the closed position and the open position and vice versa, during which movement the connecting element allows the thrust element to go from the tight configuration to the slack configuration and vice versa, the bearing member also being suitable to be out of contact with the wall of the opening when the base body is in the open position, and to come into contact with the wall when the base body is in an intermediate position.

According to particular embodiments, the sealing device comprises one or more of the following features:

- the linking element is adapted to guide the second end of the thrust element when the base body is moved between the open position and the closed position.
- the thrust element is a cylinder, in particular a gas cylinder, or a spring, in particular a helical spring;

- the linking element is either a connecting rod, or a flexible element such as a cable, rope or chain;
- the linking element supports the bearing member;
- the first end of the thrust element is connected to the base body by a first hinge around a first hinge axis (A-A).
- the second end of the thrust element is connected to the linking element by a second hinge around a second hinge axis (B-B).
- the linking element is connected to the base body by a third hinge around a third hinge axis (C-C).
- a sealing device that makes up a single-piece handleable autonomous module.

The invention also relates to an assembly comprising a frame and a sealing device, the frame delimiting an opening having a surrounding wall, the sealing device is a device as defined above, and in that the base body can move between its opening and closing positions in the frame.

According to particular embodiments, the assembly comprises one or more of the following features:

- between the intermediate position of the base body and the closed position, the surrounding wall applies a reaction force on the linking member, the reaction force being oriented against a force exerted by the thrust element;
- the frame and the sealing device comprise at least one first hinge suitable for allowing tilting of the base body relative to the frame between its open and closed positions around a first tilting axis (X-X);
- the first hinge is adapted to allow the sealing device to move relative to the frame into a blocking position at least when the base body is in its open position, in which blocking position the base body is blocked from tilting toward the closed position;
- the movement into the blocking position is a tilting of the base body around a second tilting axis (Y-Y), and in that the second tilting axis (Y-Y) extends substantially perpendicular relative to the first tilting axis (X-X);
- the frame and the sealing device comprise a second hinge suitable for allowing the base body to tilt between its open and closed positions around the first tilting axis (X-X), the second hinge having a knuckle of the sealing device and a frame knuckle, and in that the blocking of the second hinge is obtained by engaging the knuckle of the sealing device in a recess of the knuckle (20) of the frame.

BRIEF DESCRIPTION OF THE SEVERAL VIEWS OF THE DRAWINGS

The invention will be better understood upon reading the following description, provided solely as an example and done in reference to the appended drawings, in which.

DETAILED DESCRIPTION OF THE INVENTION

Figure 1:
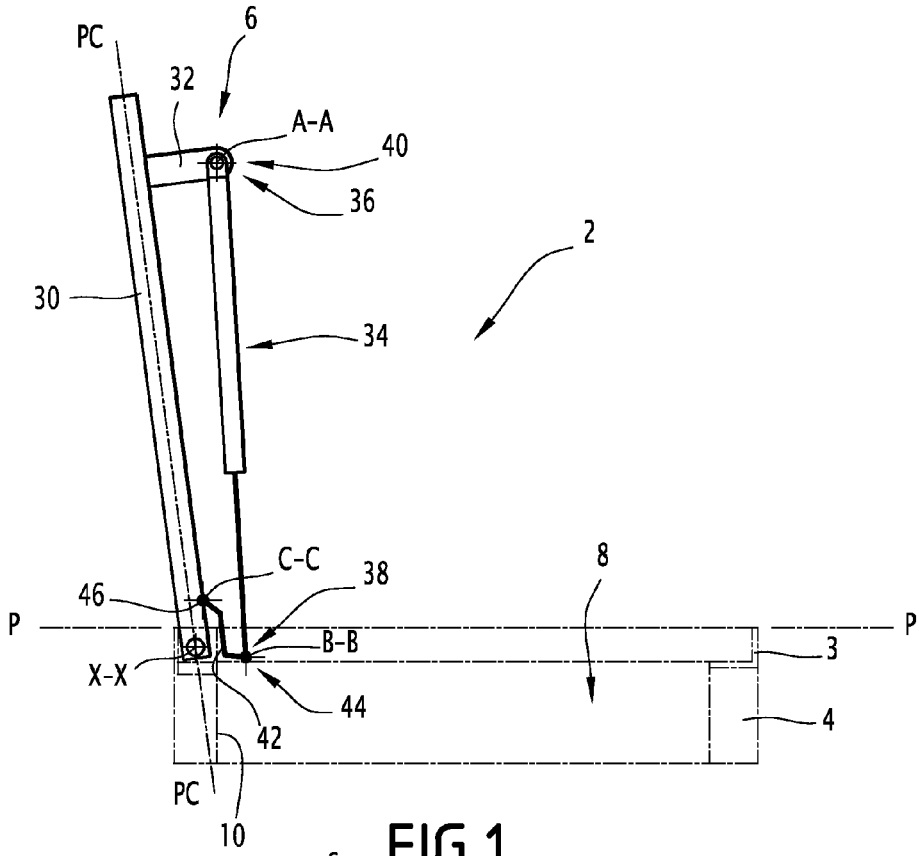
FIG. 1 is a diagrammatic side view of an assembly made up of a frame and a sealing device according to the invention, the base body being in a completely open position.

FIG. 1 shows an assembly according to the invention, designated by general reference 2. In FIGS. 1 to 6, the assembly 2 is illustrated diagrammatically so as to explain the operating principle.

The assembly 2 comprises a frame 3 sealed at the apex of an underground chamber 4 and a sealing device 6.

The assembly 2 is for example a manhole or access hatch to an underground chamber, such as a telecommunications chamber.

The frame 3 delimits an opening 8, for example square or circular, and, in the case at hand, its inner edge is aligned with an inner wall 10 of the chamber 4, the wall 10 thereby forming a wall surrounding the opening 8 to be sealed. The opening 8 extends in an opening plane P-P, which is parallel to the ground when installed. The wall 10 extends substantially perpendicular to the opening plane P-P.

Figure 5:
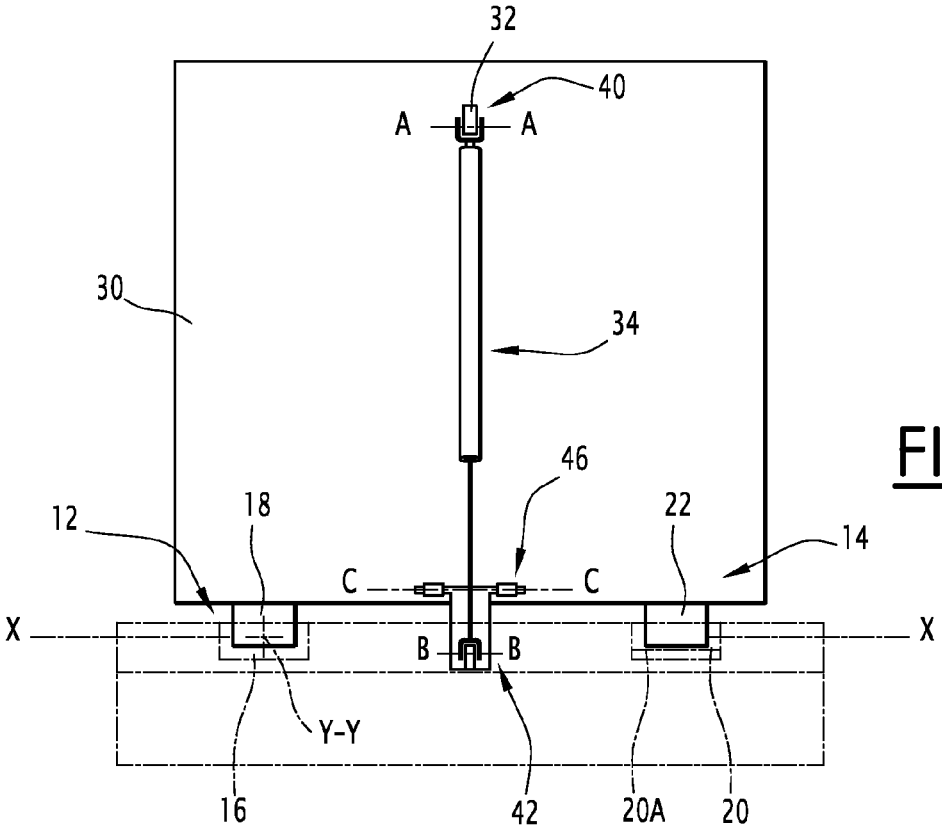
FIG. 5 is a front view of the assembly of FIG. 2, the base body being in an open unblocking position.
Figure 6:
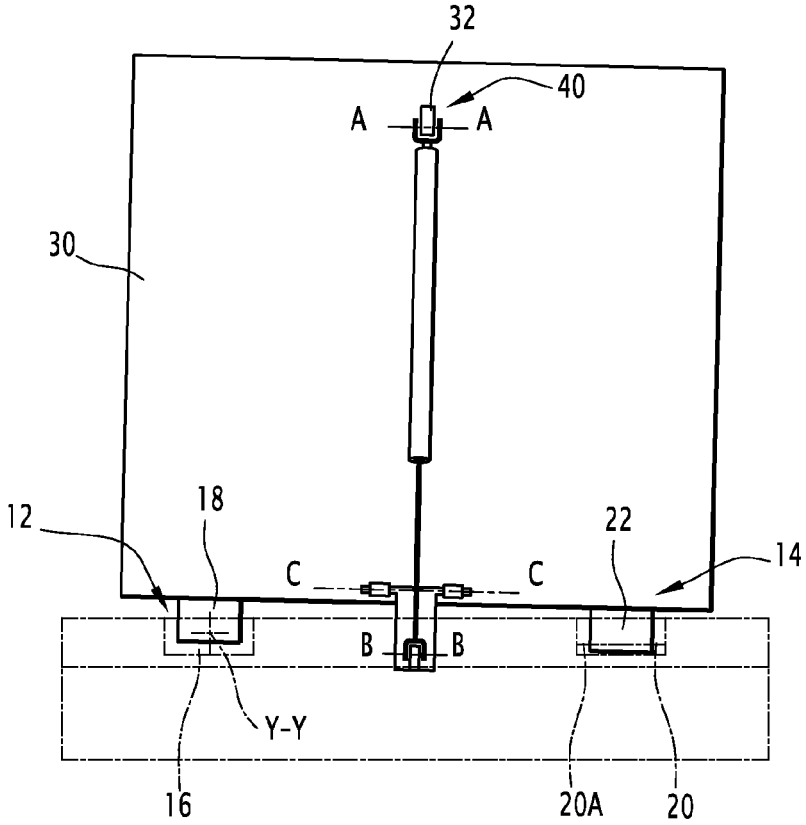
FIG. 6 is a view similar to that of FIG. 5, the base body being in an open blocking position.
Figure 7:
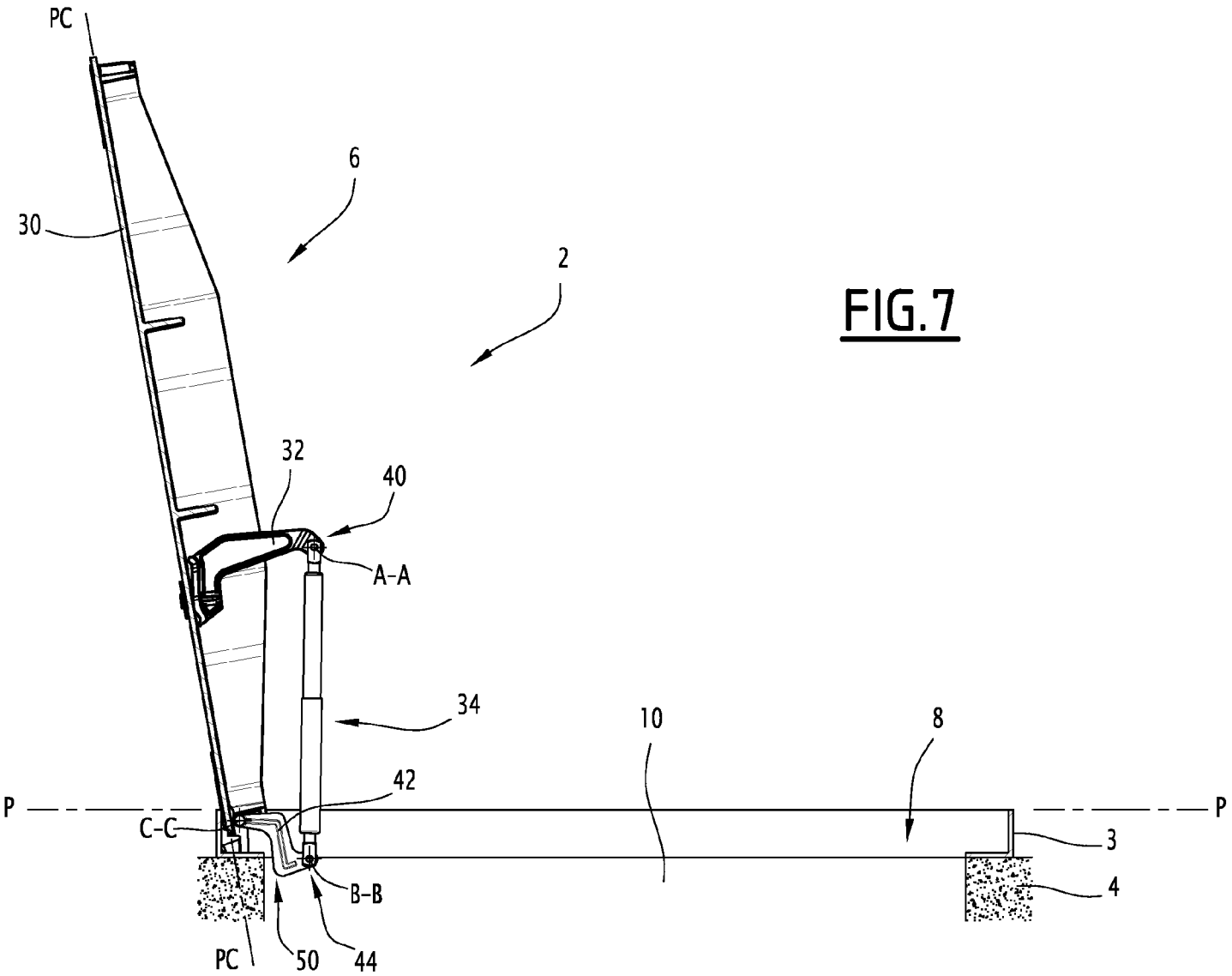
FIGS. 7 and 8 are side and perspective views of one concrete embodiment of the assembly according to the invention, the base body being in the completely open position corresponding to FIG. 1.

The frame 3 and the sealing device 6 comprise first and second hinges 12, 14 (see FIGS. 5 and 6). The first hinge 12 is made up of two cooperating knuckles 16, 18 and the second hinge 14 is made up of two cooperating knuckles 20, 22.

The sealing device 6 comprises a base body 30 suitable for sealing the opening 8. The base body 30 is for example a cover or a grate. The base body 30 extends along a base body plane PC-PC.

Figure 2:
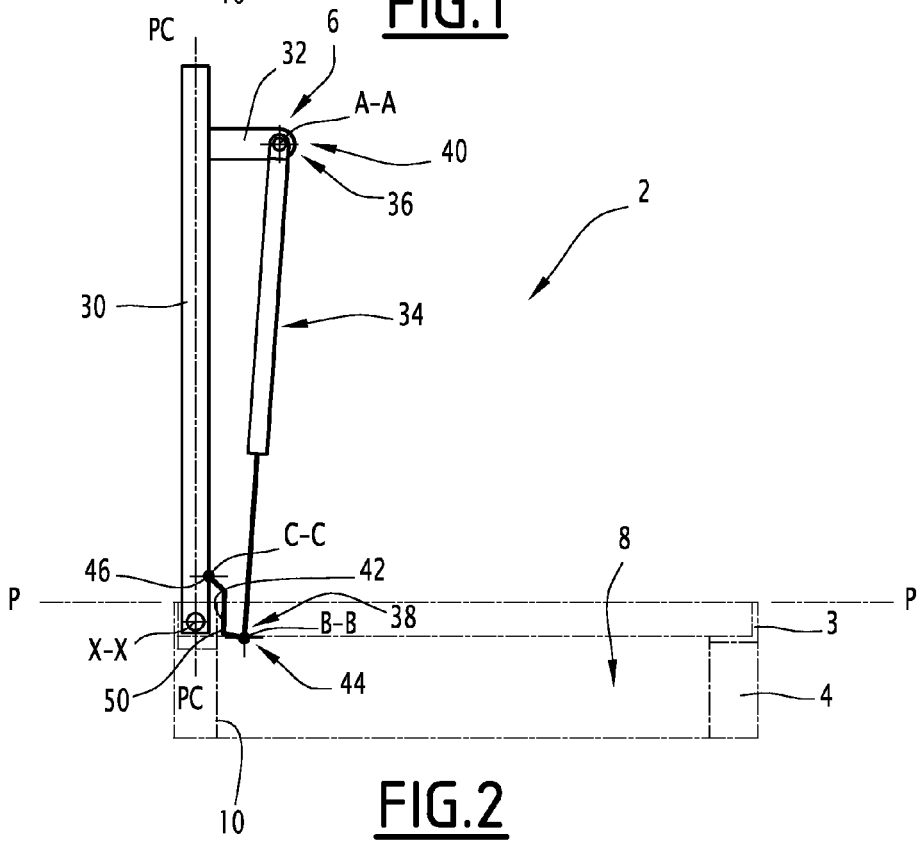
FIG. 2 is a view similar to that of FIG. 1, the base body being in an open position.
Figure 3:
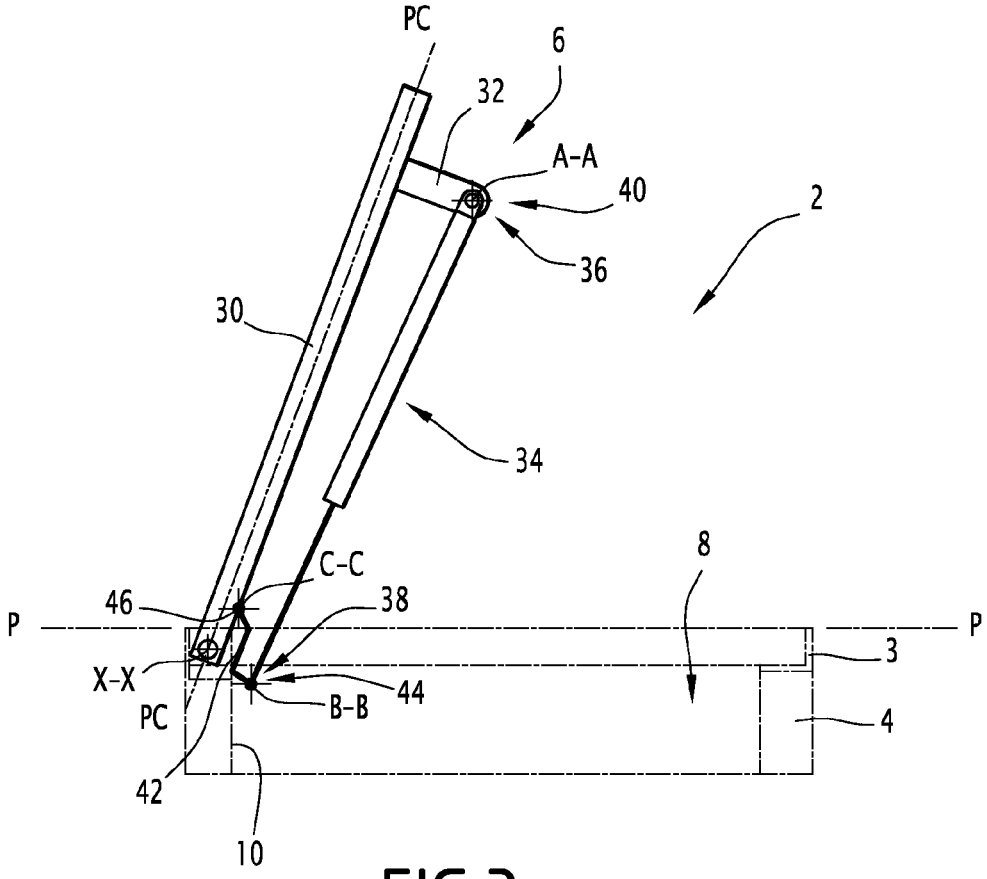
FIG. 3 is a view similar to that of FIG. 1, the base body being in an intermediate position and the linking element coming into contact with a wall of the opening to be sealed.
Figure 4:
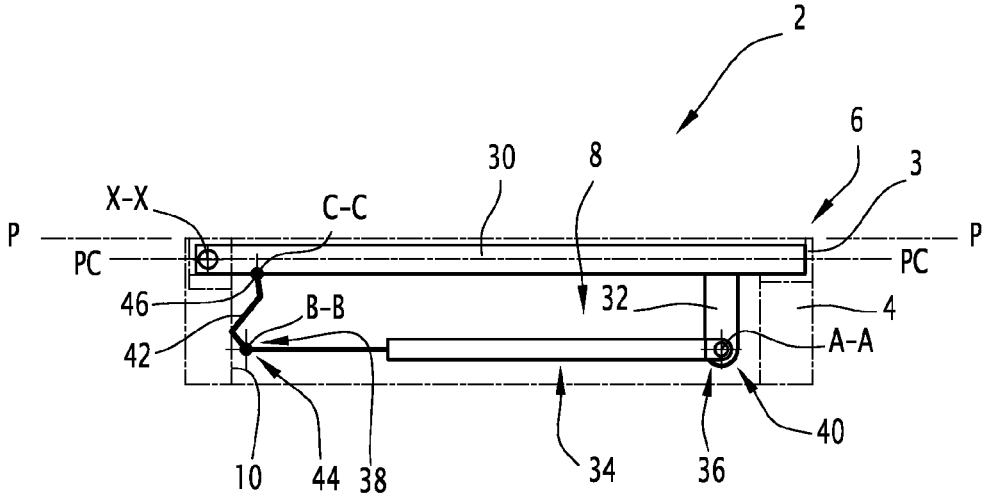
FIG. 4 is a view of the assembly of FIG. 1, the base body being in a closed position.

The hinges 12, 14 are suitable for allowing the base body 30, or sealing device 6, to tilt relative to the frame 3 around a first tilting axis X-X between a completely open position, shown in FIG. 1, an open position, shown in FIG. 2, an intermediate position, shown in FIG. 3, and a closed position, shown in FIG. 4.

The first and second hinges 12, 14 are also suitable for allowing the sealing device 6 to tilt relative to the frame 3 around a second tilting axis Y-Y between a freed position (FIG. 5) and a blocking position (FIG. 6), when the base body 30 or the sealing device 6 is in its open or completely open position. The second tilting axis Y-Y extends perpendicular to the first tilting axis X-X. Preferably, the second tilting axis Y-Y extends substantially in the opening plane P-P.

To that end, the first hinge 12 has a degree of rotational freedom of the sealing device 6 around the second tilting axis Y-Y relative to the frame 3. Furthermore, the second hinge 14 comprises means for blocking the sealing device 6 in the open position of FIG. 2. These blocking means are for example formed by a recess 20A made in the frame knuckle 20 of the second hinge and receiving the knuckle 22 of the sealing device. In the blocking position, tilting of the base body 30 toward the intermediate or closed position is prevented, while in the freed position, the base body 30 can be tilted into its closed position.

In the closed position, the base body plane PC-PC is substantially parallel to the plane P-P (see FIG. 4), and in the intermediate position, the base body plane PC-PC is inclined relative to the plane P-P by about 60° to 85°. In the open position (FIG. 2), the base body plane PC-PC is inclined by 90° relative to the plane P-P. In the completely open position (FIG. 1), the base body plane PC-PC is inclined by approximately 100 to 105° relative to the plane P-P.

The sealing device 6 also comprises a fastening protrusion 32 fastened to the base body 30 and extending substantially perpendicular relative to the base body plane PC-PC.

The sealing device 6 is provided with a thrust element 34 having first 36 and second 38 ends. The thrust element 34 is for example a cylinder, in particular a gas cylinder, or a spring, in particular a helical spring.

The thrust element 34 has a slack configuration in which its two ends 36, 38 are remote from one another, and a tight configuration in which its two ends 36, 38 are close to one another, compared to the slack configuration. The force exerted by the thrust element 34 is greater in the tight configuration than in the slack configuration. In the closed position of the base body 30, the thrust element 34 is in its tight configuration and in the open position, the thrust element 34 is in its slack configuration.

The first end 36 of the thrust element 34 is hinged to the fastening protrusion 32 by a first hinge 40 around a first hinge axis A-A. The first end 36 is therefore connected to the base body 30, by means of said hinge 40 and the fastening protrusion 32.

The sealing device 6 also comprises a linking element 42.

The second end 38 of the thrust element 34 is connected to said linking element 42 by a second hinge 44 around a second hinge axis B-B. The linking element 42 is connected to the base body 30 by a third hinge 46 around a third hinge axis C-C. The three hinge axis A-A, B-B and C-C of the hinges 40, 44, 46 are parallel to one another and are not coplanar. In other words, in cross-section along a plane perpendicular to the hinge axis A-A, B-B and C-C, these three axis form a triangle. Each hinge 40, 44, 46 has a single degree of rotational freedom, but no other degree of freedom.

The linking element 42 comprises ends on which the second and third hinges 44, 46 are positioned.

The linking element 42 is hinged to the base body 30 between two limit positions. The first limit position corresponds to the slack configuration of the thrust element 34 or the open position of the base body 30 (see FIGS. 1 and 2). The second limit position corresponds to the tight configuration of the thrust element 34 when the base body is in the closed position (see FIG. 4). The linking element 42 is therefore a connecting rod.

The linking element 42 is suitable for pivoting between its two limit positions when the thrust element 34 is brought from the tight configuration to the slack configuration and vice versa.

The linking element 42 is also adapted to guide the second end 38 of the thrust element 34 when the base body 30 is moved between the open position and the closed position.

The sealing device 6 also comprises a bearing member 50 suitable for bearing on the inner wall 10 of the opening 8 when the base body 30 is moved between the closed position and the intermediate position. This bearing member 50 is formed in the case at hand by a bent portion of the linking element 42.

It should be noted that the sealing device 6, made up of a base body 30, the thrust element 34 and the linking element 42, constitutes a single-piece handleable autonomous module in the absence of the frame 3. In the absence of the frame 3 and other external forces, the sealing device 6 assumes the configuration shown in FIGS. 1 and 2, corresponding to the open or completely open position of the base body 30.

The assembly 2 according to the invention operates as follows.

The starting configuration is shown in FIG. 1. The sealing device 6 is in the completely open and freed position. The thrust element 34 is in its slack configuration. The linking element 42 is in the first limit position. The bearing member 50 of the linking element 42 is not in contact with the wall 10.

In order to close the assembly 2, the sealing device 6 is tilted around the tilting axis X-X relative to the frame 3 in the closing direction, i.e. in the clockwise direction in FIG. 1.

The sealing device 6 therefore reaches the open position, which is shown in FIG. 2. In this position, the base body plane PC-PC is positioned at 90° relative to the plane P-P. The bearing member 50 is still not in contact with the wall 10. When the closing is continued, the sealing device 6 assumes the intermediate configuration, in which the bearing member 50 comes into contact with the wall 10 (FIG. 3).

From this configuration and when the sealing device 6 is tilted from the intermediate position toward the closed position, the application of the bearing member 50 on the wall 10 causes the linking member 42 to rotate around the hinge pin C-C and compresses the thrust element 34, which is therefore brought toward its tight configuration. The force exerted by the thrust member 34 on the linking element 42 causes a reaction force at the point of contact of the bearing member 50 with the wall 10 that goes against the gravitational force of the sealing device 6, said reaction force being applied via the wall 10 on the linking element 42. The thrust element 34 and the linking element 42 therefore prevent or slow the closing of the sealing device solely under the action of the gravitational force between the intermediate position and the closed position of the base body. The manual force needed to maneuver the sealing device 6 is consequently relatively small. This manual force depends on the thrust element 34 used, and more specifically the thrust capacity thereof.

Once the base body 30 is in its closed position (FIG. 4), the thrust element 34 is completely compressed and the linking element 42 is in its second limit position.

In order to open the assembly, the base body 30 is tilted by the user toward its open position. Between the closed position and the intermediate position, the force exerted by the thrust element 34 and transmitted by the linking element 42 to the wall 10 causes, at the wall 10, a reaction force that opposes the base body's own weight and consequently makes it possible to considerably reduce the force needed to open the sealing device 6. During said tilting, the thrust element 34 slackens.

Once the intermediate position is reached, the linking element 42 and the bearing member 50 lose contact with the wall 10 and the sealing device 6 is tilted into its completely open position under only the action of the force of the user, passing through the freed open position of FIG. 5.

Owing to the fact that the sealing device 6, made up of a base body 30, the thrust element 34, and the linking element 42, constitutes a single-unit handleable autonomous module, the frame 3 and the sealing device 6 can be manufactured and installed separately. Thus, relatively unqualified labor is sufficient to mount the sealing device 6 in the frame 3 on the installation site of the assembly 2.

Furthermore, the device 6 is easily usable to equip the already existing and installed frames 3. The placement or removal of the sealing device 6 is also easy and risk-free, as these operations are done without having to act on the thrust element 34 inasmuch as the latter is not secured to the frame.

The combination of the sealing device 6 and the hinges 12, 14 allowing blocking by tilting around the tilting axis Y-Y is particularly advantageous, given that no hinging of the end 38 of the thrust element 34 to the frame 3 is necessary.

FIGS. 7 to 15 show elements of one concrete embodiment of the invention. Only the particularities relative to the diagrammatic embodiment above will be explained. Similar elements bear the same references.

Figure 8:
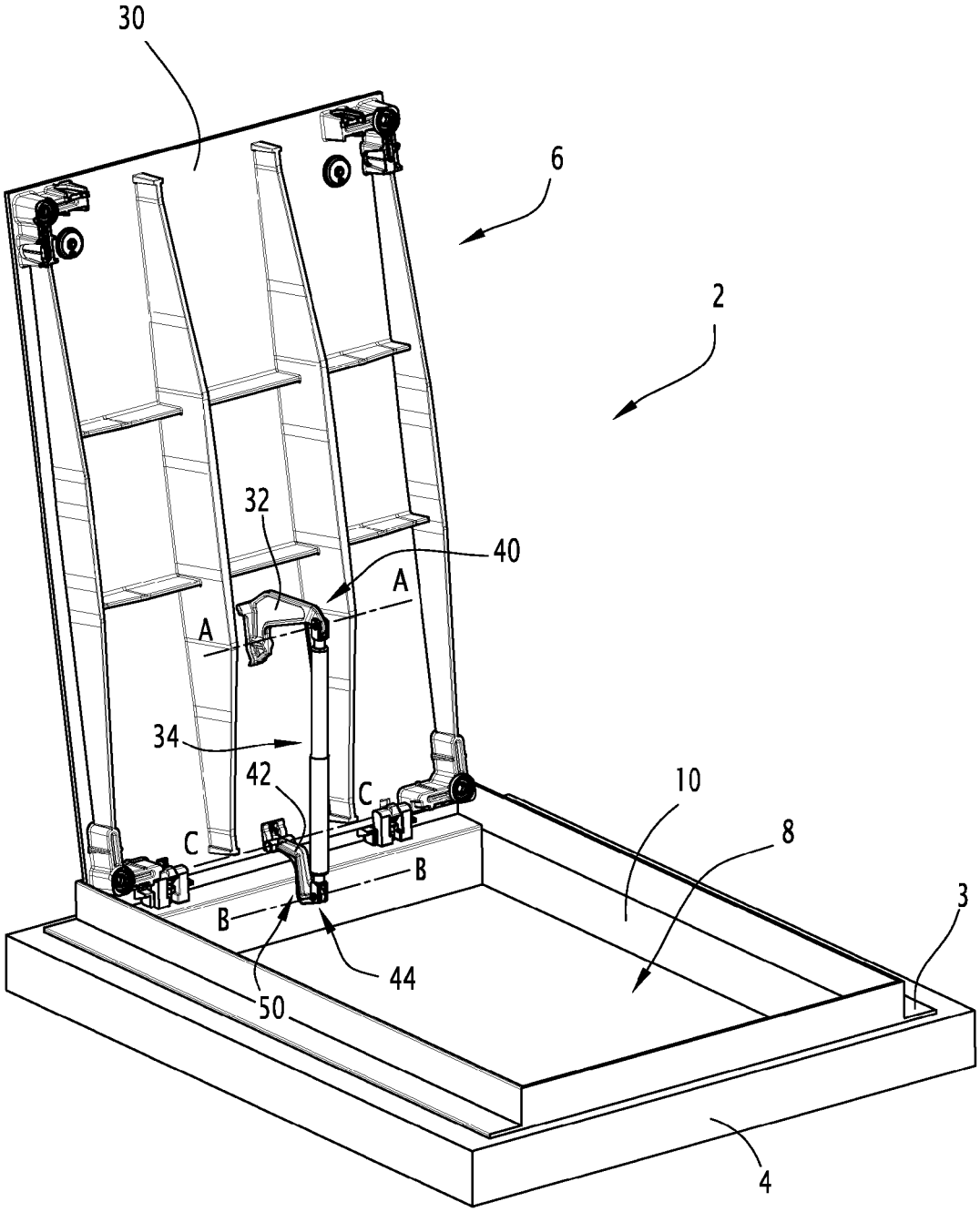
Figure 9:
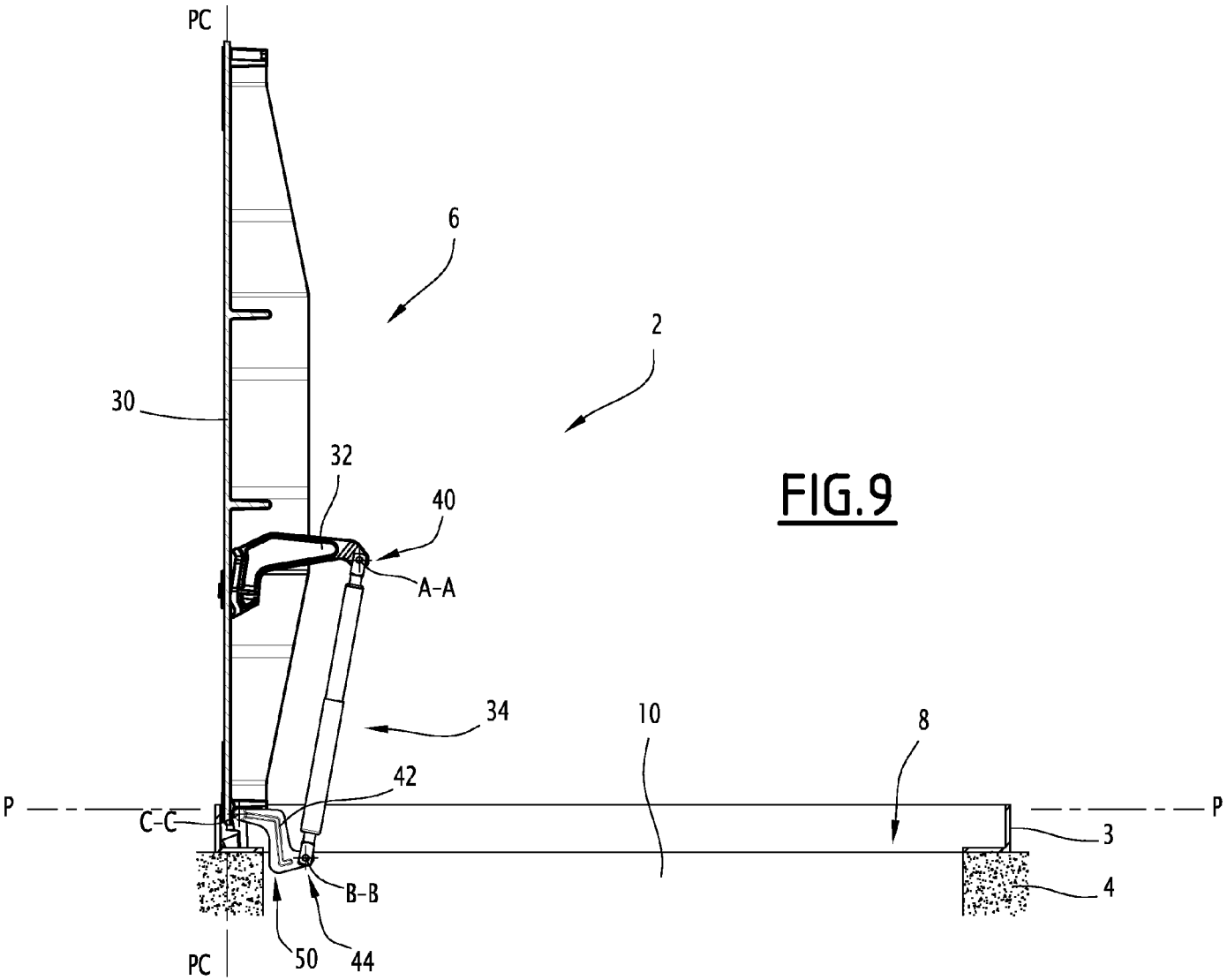
FIGS. 9 to 11 are cross-sectional side views of the assembly of FIG. 7, the base body being in open, intermediate and closed positions corresponding to the positions of FIGS. 2 to 4.
Figure 10:
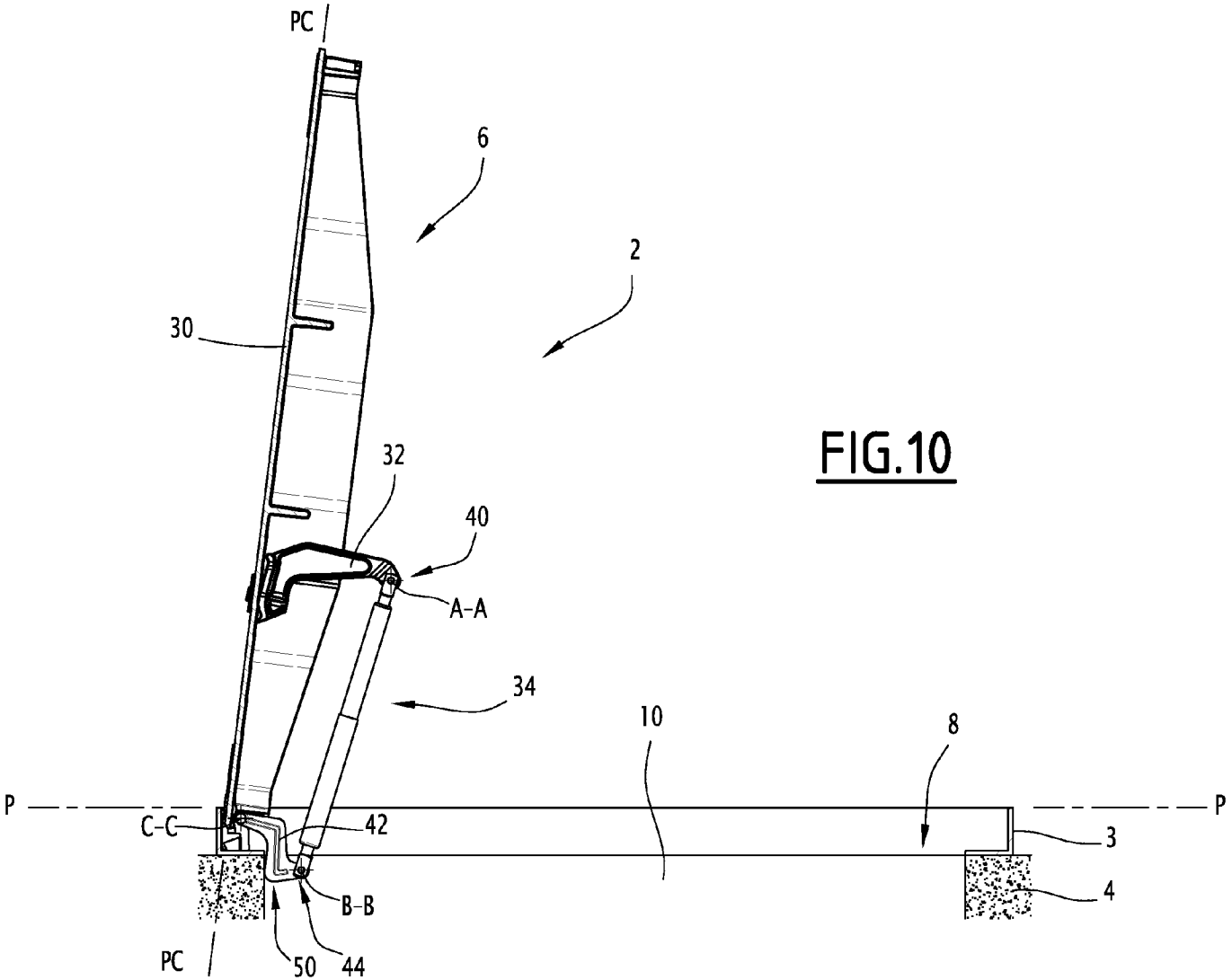
Figure 11:
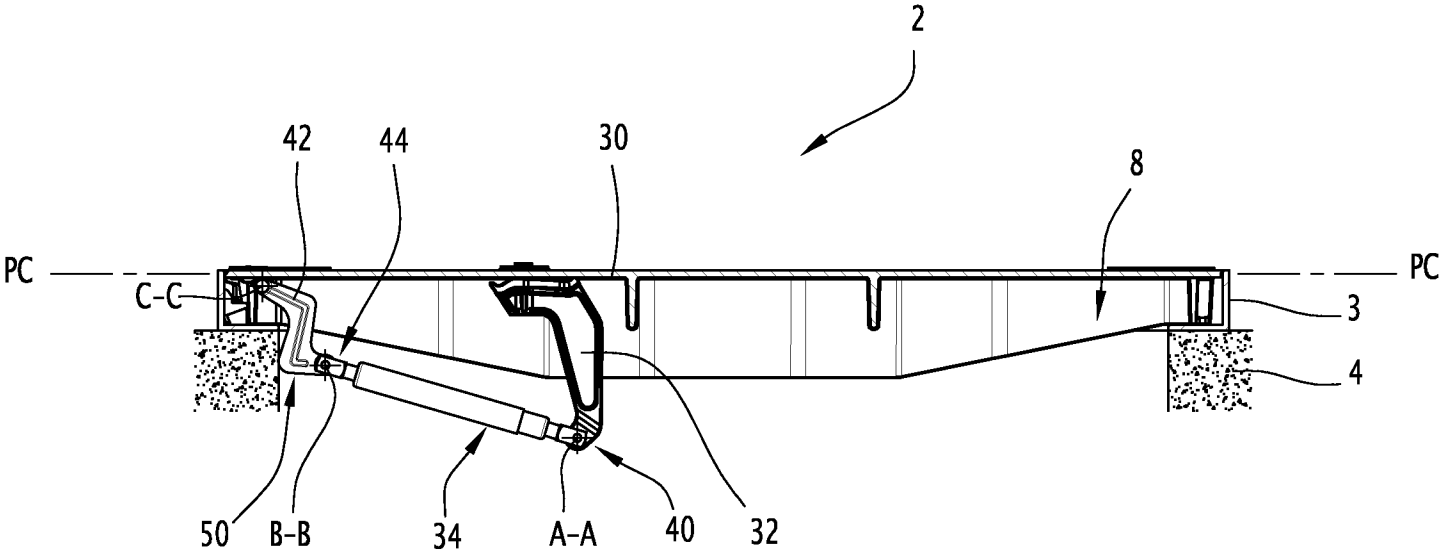

FIGS. 7 and 9 to 11 correspond to FIGS. 1 to 4. FIG. 8 is a perspective view of the assembly 2 in the completely open position.

The sealing device 6 includes a base body 30 and a fastening protrusion 32 that are manufactured in two separate pieces and assembled. The fastening protrusion 32 is fastened to the base body 30 by shape matching using a link. This link is preferably a bayonet link.

Figure 15:
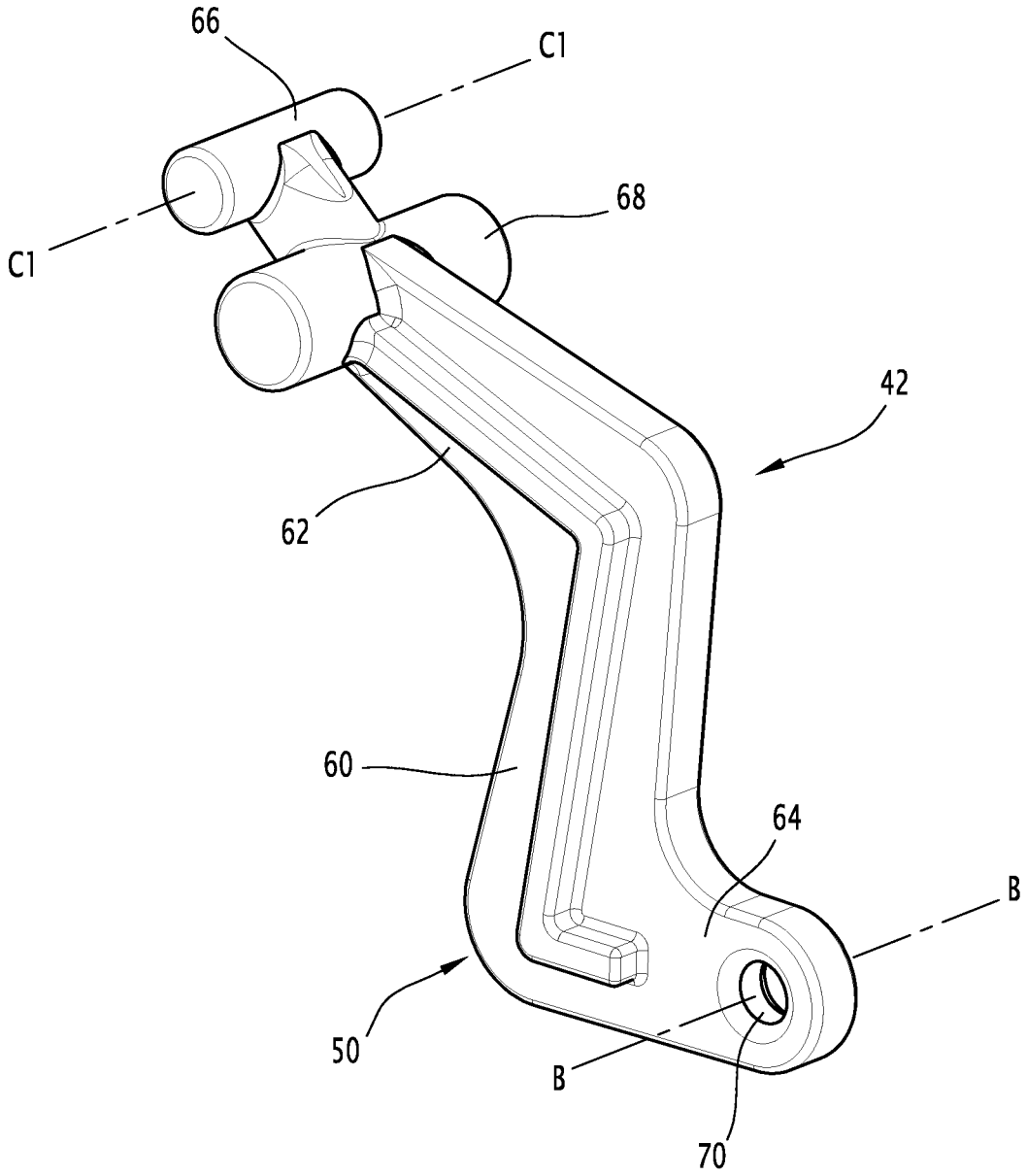
FIG. 15 is a perspective view of the linking element.

FIG. 15 illustrates the linking element 42. The linking element 42 includes a central core 60 and two side wings 62, 64.

The free end of the side wing 62 supports a cylindrical tip 66 defining a tip axis C1-C1. The tip 66 is made up of two half-tips that extend on either side of the side wing 62.

The side wing 62 also supports a cylindrical stop 68 that cooperates with the lower surface of the base body 30 so as to ensure the maintenance and rotational guiding of the tip 66 when the linking element 42 is pivoted around the axis C1-C1.

The side wing 64 supports a hinge opening 70 at its end adapted to be hinged to the end 38 of the thrust element 34 and defining the hinge pin B-B.

The junction area between the side wing 64 and the central core 60 forms the bearing member 50.

Figure 12:
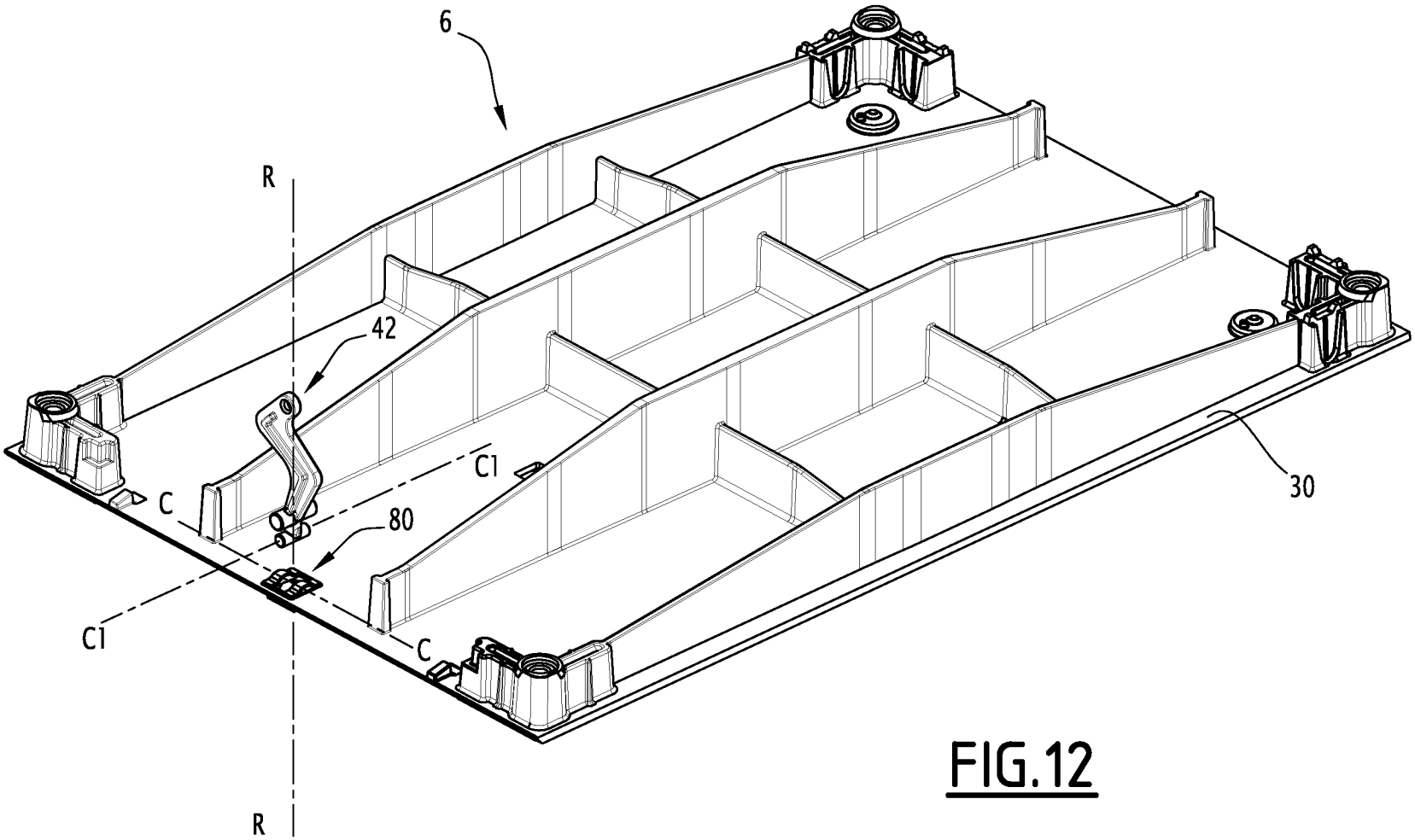
FIGS. 12 to 14 show a perspective view of the base body of the sealing device and a connecting element in different assembly stages.
Figure 13:
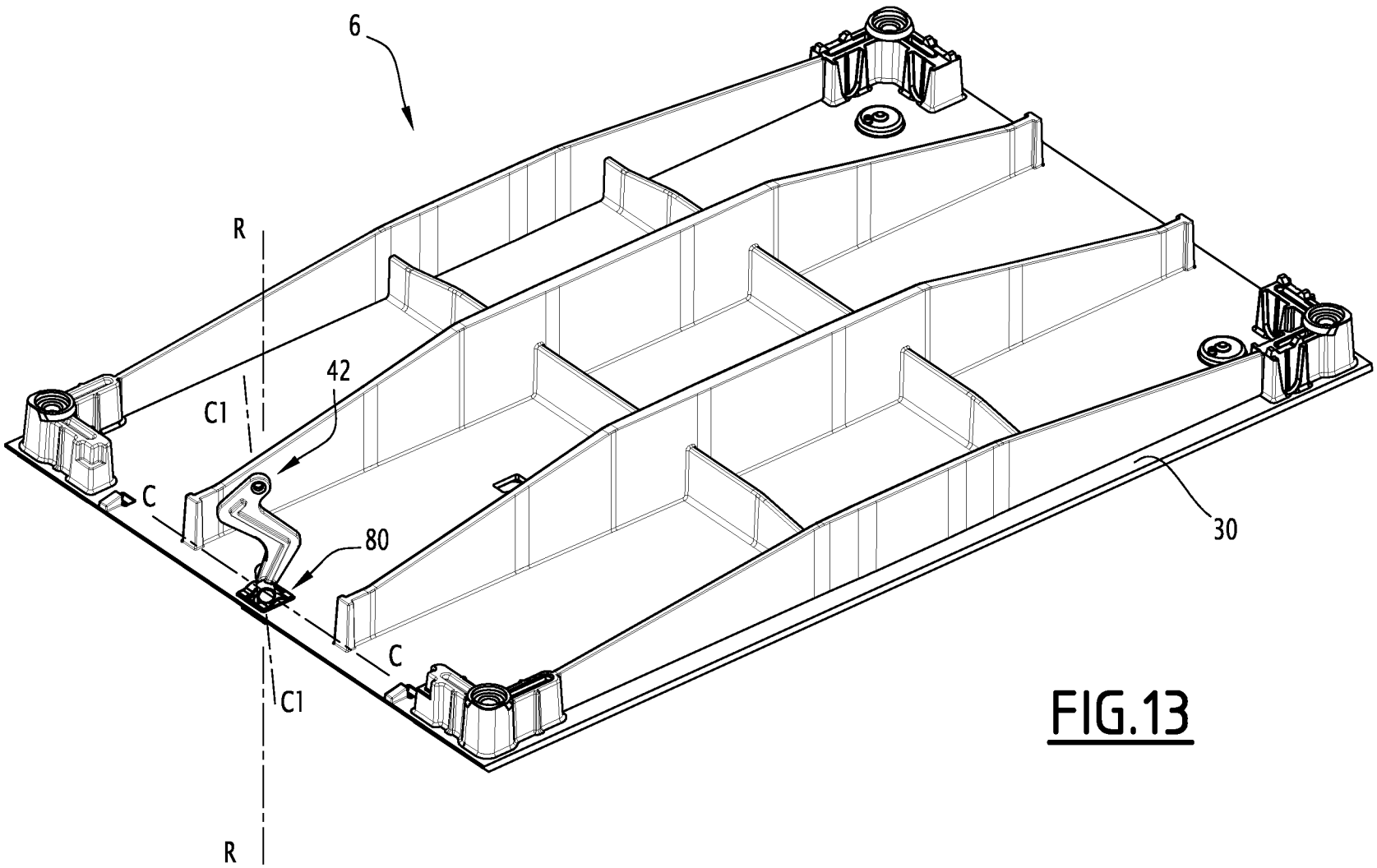
Figure 14:
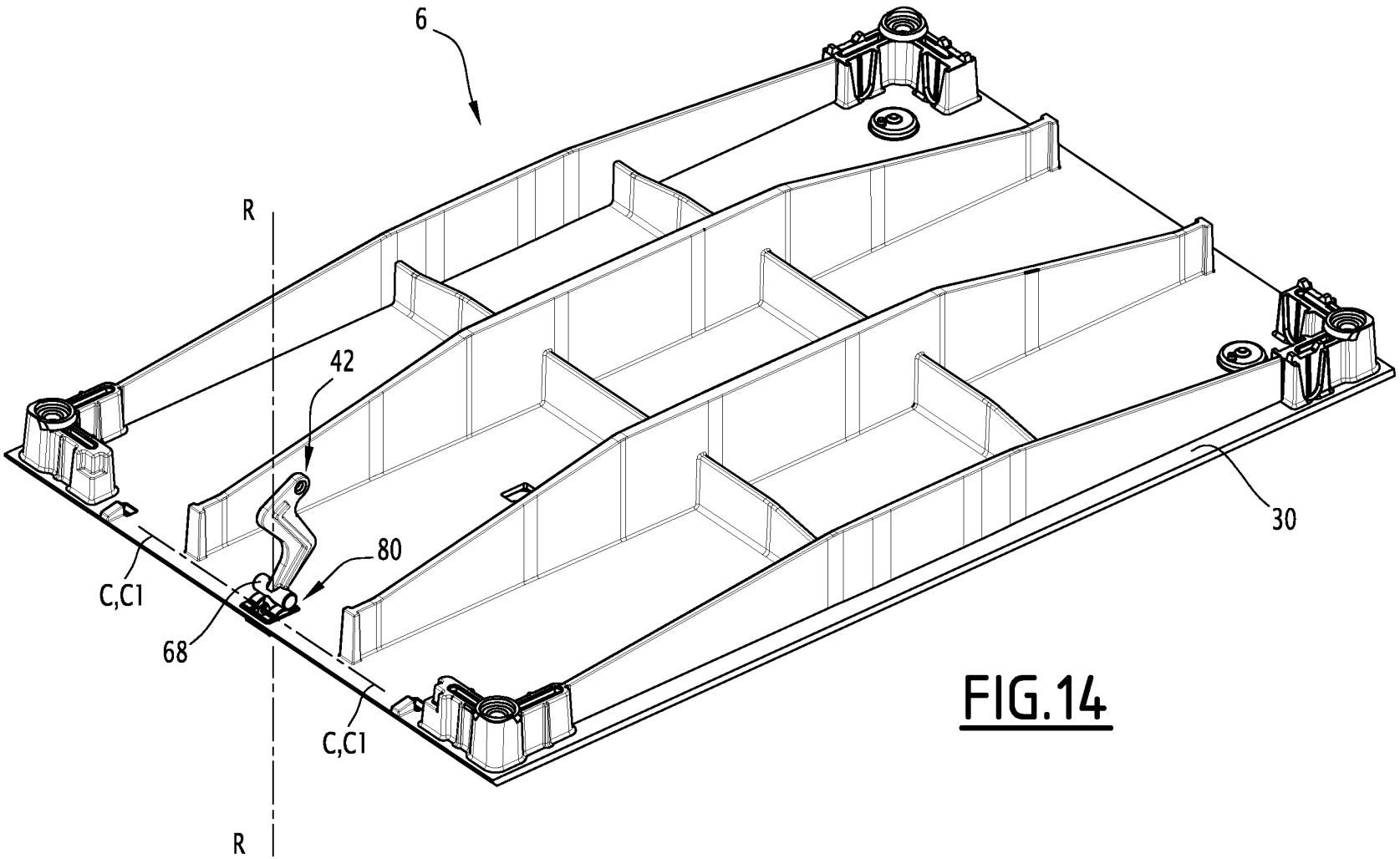

FIGS. 12 to 14 show the assembly operation of the linking element 42 in the base body 30.

The base body 30 includes a housing 80 adapted to receive the cylindrical tip 66.

During a first step (FIG. 12), the linking element 42 is aligned with the housing 80 such that the tip axis C1-C1 is angularly offset from the hinge axis C-C. Then, the tip 66 is inserted into the housing 80 through a movement perpendicular to the plane PC-PC and followed by a rotation around an axis of rotation R-R extending perpendicular to the plane PC-PC (FIG. 13), until the tip axis C1-C1 is aligned with the tilting axis C-C (FIG. 14).

The assembly is therefore particularly easy and is done without tools and without other components, such as pins.

Then, the mounting protrusion 32 is connected to the base body according to the same principle and the thrust element 34 is connected by the hinge 40 to the protrusion 32 and by the hinge 44 to the opening 70 of the linking element 42.

In an alternative not shown, the linking element 42 is provided with adjusting means for adapting to a chamber whereof the wall 10 is withdrawn relative to the frame 3, the adjusting means then allowing the bearing member 50 to come into contact with the wall 10 when the base body 30 is in an angular position situated between the closed position and the intermediate position.

Also alternatively, when the frame has a vertical inner wall delimiting the opening 8 and extending downward over a sufficient distance, the bearing member 50 can come into direct contact with said vertical wall of the frame and not with a wall 10 of the underground chamber.

Lastly, in another embodiment not shown, the rigid linking element 42 described above may be replaced by a flexible linking element such as a cable, rope or chain, for instance. In that case, it is either the flexible linking element or the end 38 of the thrust element 34 that bears against the wall 10 when the base body is situated between the closed position and the intermediate position. It is then no longer necessary to connect said flexible linking element to the base body and the thrust element using hinges.

The invention claimed is:

1. A sealing device, including:

a base body suitable for sealing an opening, movable between an open position and a closed position, a pushing element having first and second ends, and a first configuration and a second configuration, the first configuration being a slack configuration with respect to the second configuration, which second configuration is a tensioned configuration with respect to the first configuration, the first end of the pushing element being connected to the base body, wherein the sealing device also includes a linking element having a first end translationally fixed to the base body and a second end translationally fixed to the second end of the pushing element, as well as a bearing member adapted to bear on a wall surrounding the opening when the base body is moved between the closed position and the open position and vice versa, during which movement the linking element moves the pushing element from the second configuration to the first configuration and vice versa, the bearing member being out of contact with the wall of the opening when the base body is in the open position, and the bearing member coming into contact with the wall when the base body is in an intermediate position.

2. The sealing device according to claim 1, wherein the linking element is adapted to guide the second end of the pushing element when the base body is moved between the open position and the closed position.

3. The sealing device according to claim 1, wherein the pushing element is selected from the group consisting of a cylinder, a gas cylinder, a spring, and a helical spring.

4. The sealing device according to claim 1, wherein the linking element is selected form the group consisting of a connecting rod, and a flexible element.

5. The sealing device according to claim 4, wherein the flexible element is selected from the group consisting of a cable, a rope, and a chain.

6. The sealing device according to claim 1, wherein the linking element supports the bearing member.

7. The sealing device according to claim 1, wherein the first end of the pushing element is connected to the base body by a first hinge around a first hinge axis.

8. The sealing device according to claim 1, wherein the second end of the pushing element is connected to the linking element by a second hinge around a second hinge axis.

9. The sealing device according to claim 1, wherein the linking element is connected to the base body by a third hinge around a third hinge axis.

10. The sealing device according to claim 1, wherein the sealing device constitutes a single-piece handleable autonomous module.

11. An assembly comprising a frame and a sealing device, the frame delimiting an opening having a surrounding wall, wherein the sealing device includes:

a base body suitable for sealing the opening, movable between an open position and a closed position in the frame, a pushing element having first and second ends, and a first configuration and a second configuration, the first configuration being a slack configuration with respect to the second configuration, which second configuration is a tensioned configuration with respect to the first configuration, the first end of the pushing element being connected to the base body, and a linking element having a first end translationally fixed to the base body and a second end translationally fixed to the second end of the pushing element, as well as a bearing member adapted to bear on the wall surrounding the opening when the base body is moved between the closed position and the open position and vice versa, during which movement of the linking element moves the pushing element from the second configuration to the first configuration and vice versa, the bearing member being out of contact with the wall surrounding the opening when the base body is in the open position, and the bearing member coming into contact with the wall when the base body is in an intermediate position.

12. The assembly according to claim 11, wherein between the intermediate position of the base body and the closed position, the surrounding wall applies a reaction force on the linking member, the reaction force being oriented against a force exerted by the pushing element.

13. The assembly according to claim 11, wherein the frame and the sealing device comprise at least one first hinge suitable for allowing tilting of the base body relative to the frame between its open and closed positions around a first tilting axis.

14. The assembly according to claim 13, wherein the first hinge is adapted to allow the sealing device to move relative to the frame into a blocking position at least when the base body is in its open position, in which blocking position the base body is blocked from tilting toward the closed position.

15. The assembly according to claim 14, wherein the movement into the blocking position is a tilting of the base body around a second tilting axis, and the second tilting axis extends substantially perpendicular relative to the first tilting axis.

16. The assembly according to claim 15, wherein the frame and the sealing device comprise a second hinge suitable for allowing the base body to tilt between its open and closed positions around the first tilting axis, the second hinge having a knuckle of the sealing device and a knuckle of the frame, and the blocking of the second hinge is obtained by engaging the knuckle of the sealing device in a recess of the knuckle of the frame.

* * * * *